US007178666B2

(12) United States Patent
Huang

(10) Patent No.: US 7,178,666 B2
(45) Date of Patent: Feb. 20, 2007

(54) CONTACT LENS HOLDER

(76) Inventor: Joey Huang, 9851 Olive St., Temple City, CA (US) 91780

( * ) Notice: Subject to any disclaimer, the term of this patent is extended or adjusted under 35 U.S.C. 154(b) by 444 days.

(21) Appl. No.: 10/853,413

(22) Filed: May 25, 2004

(65) Prior Publication Data

US 2005/0263412 A1 Dec. 1, 2005

(51) Int. Cl.
*A61F 9/00* (2006.01)

(52) U.S. Cl. ..... 206/5.1; 206/804; 294/1.2

(58) Field of Classification Search ..... 206/5.1, 206/804; 294/1.2, 99.2; 134/137, 901; D16/331; D28/7
See application file for complete search history.

(56) References Cited

U.S. PATENT DOCUMENTS 3,063,083 A * 11/1962 Obitts ..... 15/104.92
4,387,921 A * 6/1983 Licata ..... 294/1.2
4,545,478 A * 10/1985 Waldman ..... 206/5.1
4,807,750 A * 2/1989 Ryder et al. ..... 206/5.1
5,690,211 A * 11/1997 Jao et al ..... 206/5.1
5,941,583 A * 8/1999 Raimondi ..... 294/1.2
6,000,534 A * 12/1999 Koomruian, Jr. ..... 206/5.1
6,148,992 A * 11/2000 Kanner et al. ..... 206/5.1
6,382,409 B1 * 5/2002 Scala ..... 206/5.1

* cited by examiner

*Primary Examiner*—Mickey Yu
*Assistant Examiner*—Steven A. Reynolds
(74) *Attorney, Agent, or Firm*—Clement Cheng

(57) ABSTRACT

A contact lens case includes a cup adapted to receive minimized quantity of cleaning solution and a cap removable of the opening mouth of the cup. The lens support structure is pivotally connected to the cap that holds one of a pair of lens within the cup. The lens support structure consists of a base plate where a pair of contact lenses lay on each side and is held by a pair of swiveling arms, one on each side. The lens support structure also acts as two contact lens eye wearing device, one on each side, when removed from cup and having the arms swiveled mechanically downward. When swiveled back to upright position the suction cup at the end of the swivel holds the contact lens against the lens support structure plate.

5 Claims, 6 Drawing Sheets

CONTACT LENS HOLDER

DISCUSSION OF RELATED ART

Contact lenses have become popular since their inception over a decade ago. No longer are nearsighted users bound to glasses and spectacles, but users may now scuba dive, play basketball and handle a wide variety of competitive sporting events without the traditional restraint of glasses. Recently, contact lenses have become less expensive and more affordable increasing its popularity.

One drawback of contact lenses is its susceptibility to protein deposits. Naturally occurring protein deposits in the eye built up over time and require a user to remove the contact lenses usually at night for storage in contact lens solution. The contact lenses are typically stored in a contact lens case. The traditional contact lens case includes a pair of containers forming shallow depressions each having a cap. A user typically stores a single contact lens in each shallow depression.

While it is easy for most users to remove contact lenses, it is much more difficult to install them. The disposable version of contact lenses is much softer and more difficult to install in the eye. Also, a person's hands often has irritants such as dust, flaky skin or skin lotion that can irritate the eye. This requires a person to rinse the contact lens by hand before installation. A person must also wash hands and prevent contamination by irritants. When a user goes camping or is otherwise traveling, the user may have difficulty finding water to wash hands before installing contact lenses.

A variety of travel kits include multiple case holders, bottles, disinfecting towels and tissues. One such accessory kit is shown in U.S. Pat. No. 5,915,545 and has a patent date of Jun. 29, 1999 to Shackel. While a handy invention, use of an accessory kit is sometimes too bulky. Unfortunately, most people do not like to carry too many implements unless they are absolutely necessary.

Other kits such as the one described in U.S. Pat. No. 5,236,236 to Girimont requires numerous parts and implements for cleaning, rinsing, inserting and storing an extended wear contact lens. U.S. Pat. No. 4,520,923 to Waldman shows an interesting contact lens holder configuration patented in Jun. 4, 1985. The contacts lens rests on a dome and is strapped down with a strap. The contact lens case shown in U.S. Pat. No. 4,981,657 by inventor Ryder shows a contact lens case with raised protective ribs that retains the contact lens in a basket like cover. Although the basket cover offers protection for the contact lens, the entire device still requires manual contact with contact lenses.

DETAILED DESCRIPTION OF THE PREFERRED EMBODIMENT

Figure 1:
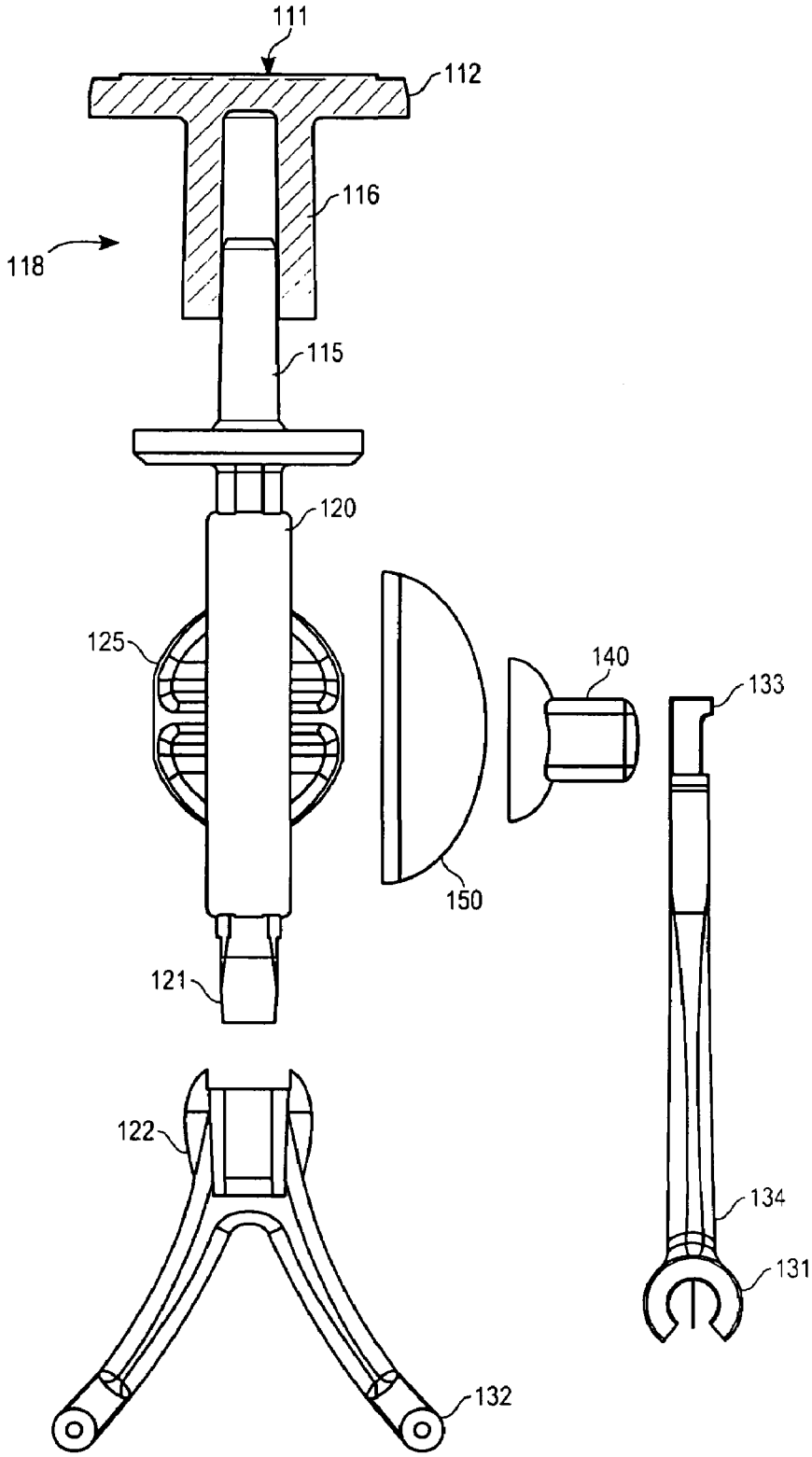
FIG. 1 is an exploded view of the holder assembly.

The imprint 111, FIG. 1 on the logo cap 112 can be molded in relief or otherwise printed on the top surface. The logo can be a trademark, or advertising slogan, or other commercial message modular and customizable by interchangeable selection of the logo imprint cap 112. The entire device can be assembled lacking the logo imprint cap allowing final assembly of inserting only the imprint cap.

Figure 3:
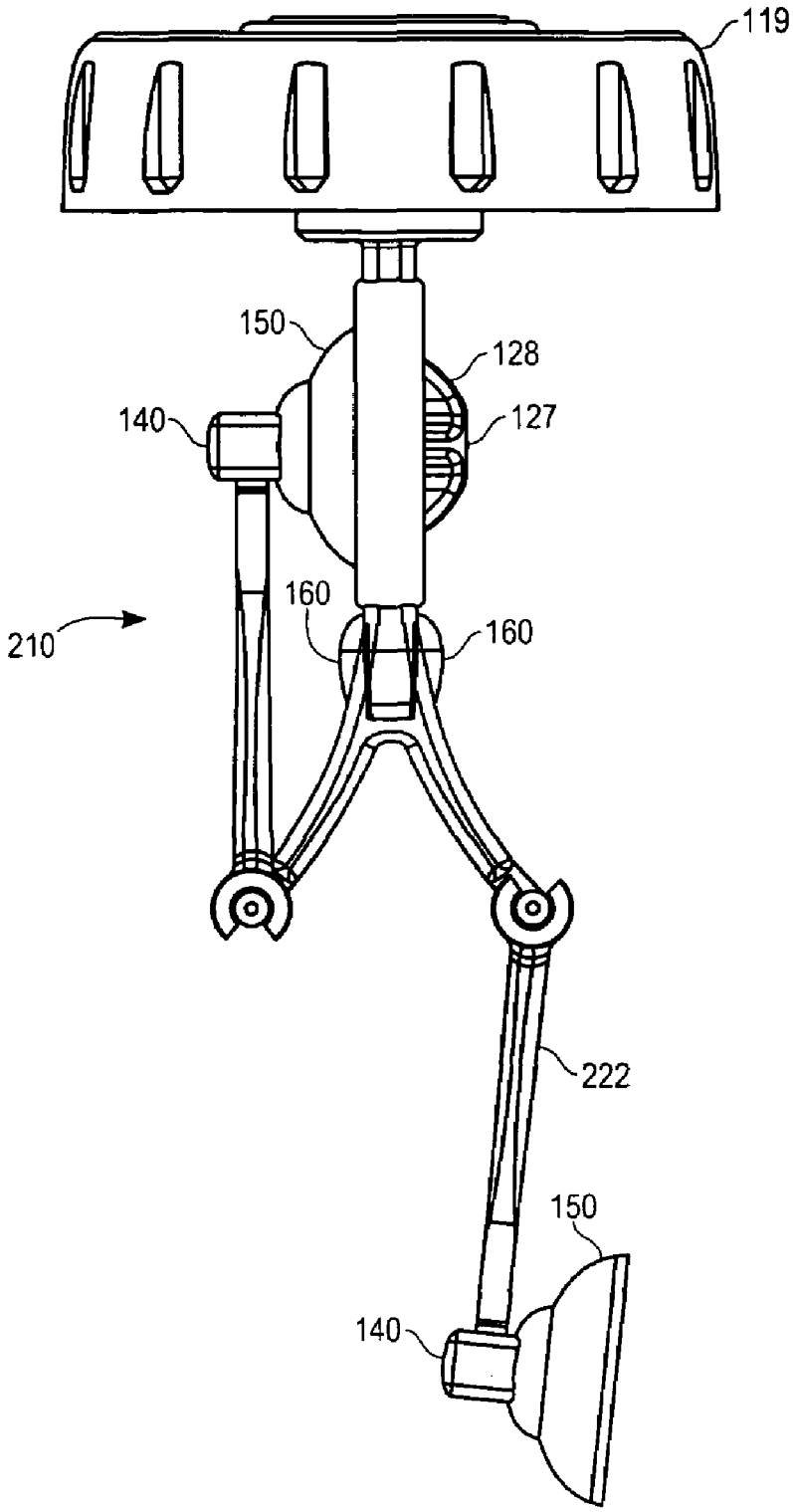
FIG. 3 is a side view of the assembled holder assembly.
Figure 4:
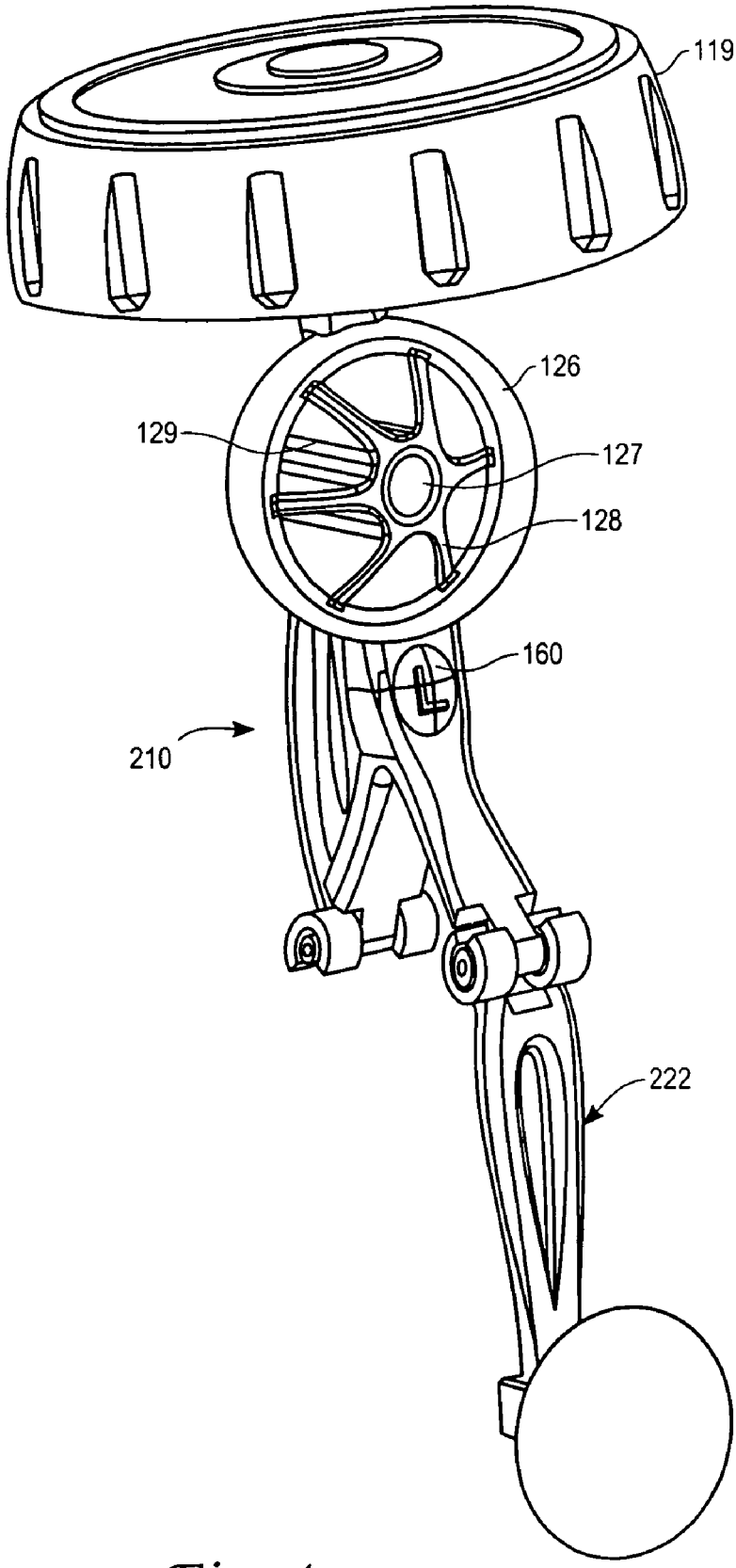
FIG. 4 is a perspective view of the holder assembly having one arm extended.
Figure 5:
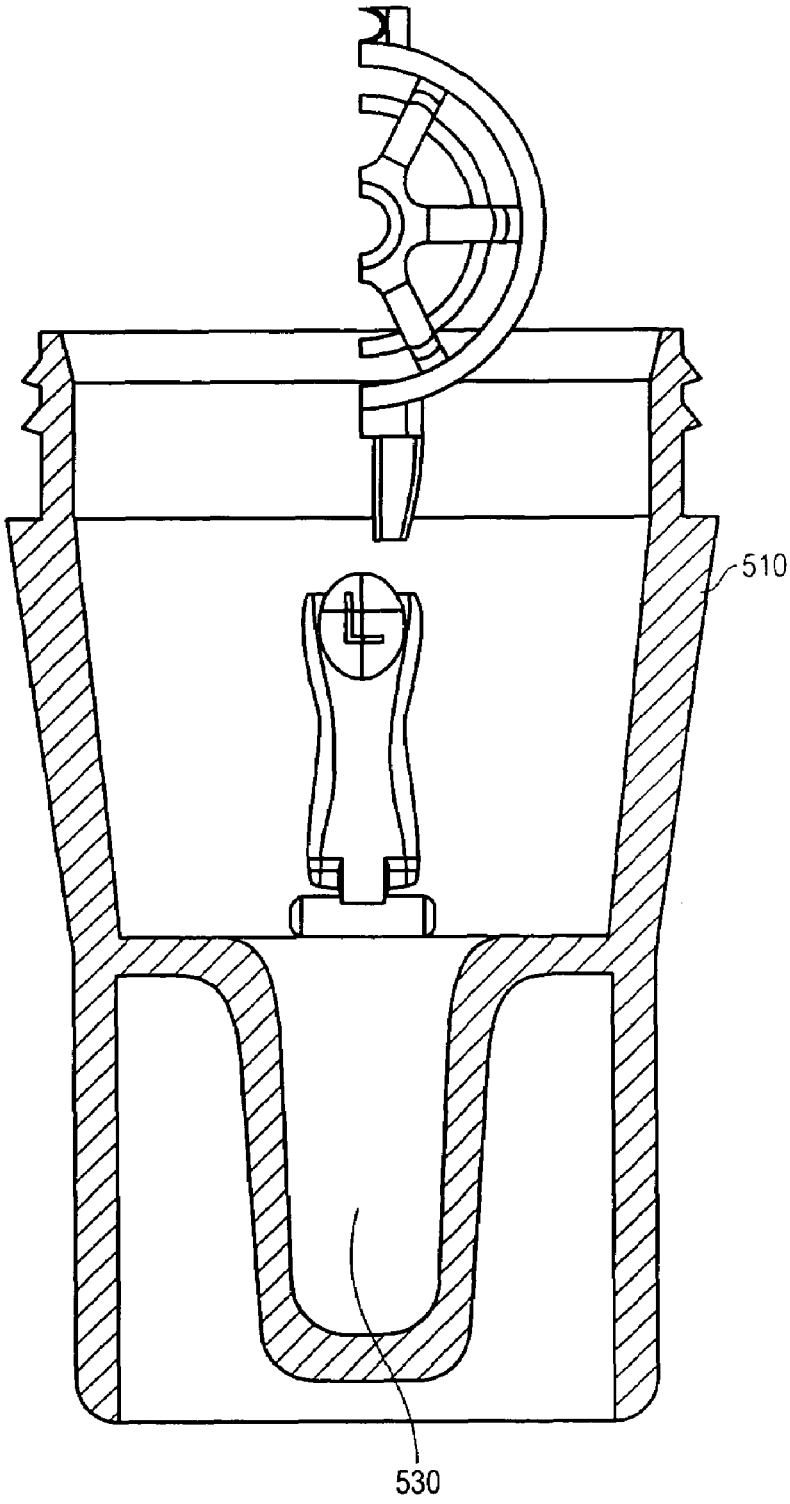
FIG. 5 is a cross sectional view of the container with portions of the holder assembly fitting into the container for showing orientation.
Figure 6:
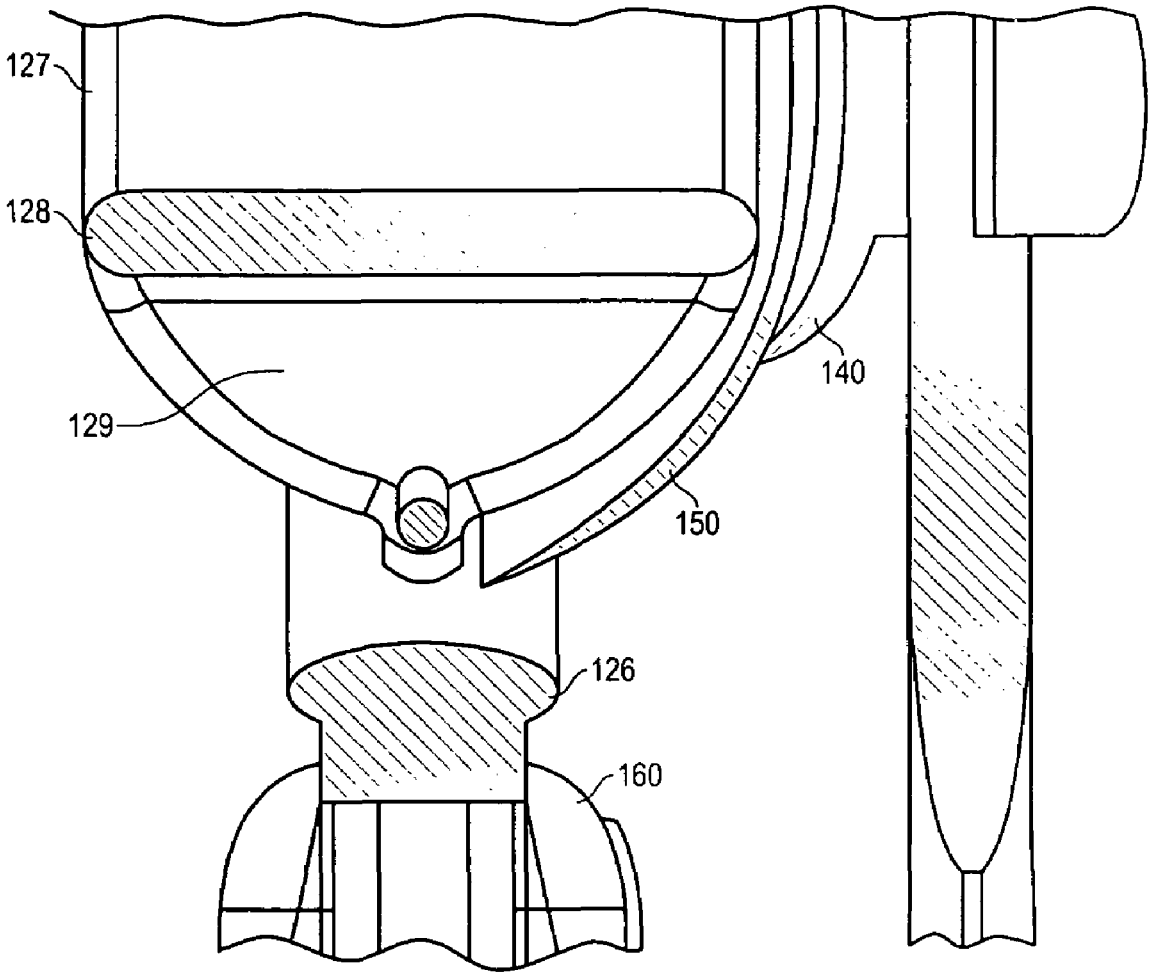
FIG. 6 is a side cross sectional view of the lens supporting member and the suction cup member holding a contact lens.

A locking outside spool 116 fits over a locking inside spool 115. The locking inside spool can be mounted to the logo imprint cap 112 and the locking outer spool 116 attached to the holder assembly 120. The inside and outside spool form a spool means 118. Between the logo imprinted cap and the holder assembly upper 120, the cap 119 not shown on FIG. 1 is sandwiched between as seen in FIG. 3, and FIG. 4. The cap 119 has a bore defining an opening such that the opening allows the cap 119 to rotate around the spool means 118. The turning of the cap 119 threaded upon the vial 510 does not rotate the spool means 118 because the spool means 118 has a clearance between it and the cap 119.

Therefore, the cap rotates while attached to the holder assembly upper portion 120. The logo imprint cap portion 112 can be formed with the cap 119 as a single piece. Once formed as a single piece, the locking outside spool can be mounted to the upper cap portion or can be mounted to the holder assembly upper portion 120. Also, the locking in side spool 115 can be mounted to the upper cap portion or be mounted to the holder assembly upper portion 120 as seen in FIG. 1. Also, the locking outside spool is not necessarily cylindrical and may have a varying cross section such that it has a larger diameter at a first end and tapers. The tapered profile biases the cap 119 in secure position when the cap 119 is closed on the container 510.

Also, the locking inner spool 115 optionally rotates around the locking outer spool 116. When the inner spool 115 rotates around the outside spool 116, the cap 119 is preferably secured in relation to the outside spool 116 not allowing rotation. The locking spools preferably have a tapered profile wherein the radius varies from a small to large radius. The profile can be seen in FIG. 1. The locking outside spool 116 and inside spool 115 snaps together and maintains a tight mechanical fit so that they do not separate in the ordinary course of usage.

Figure 2:
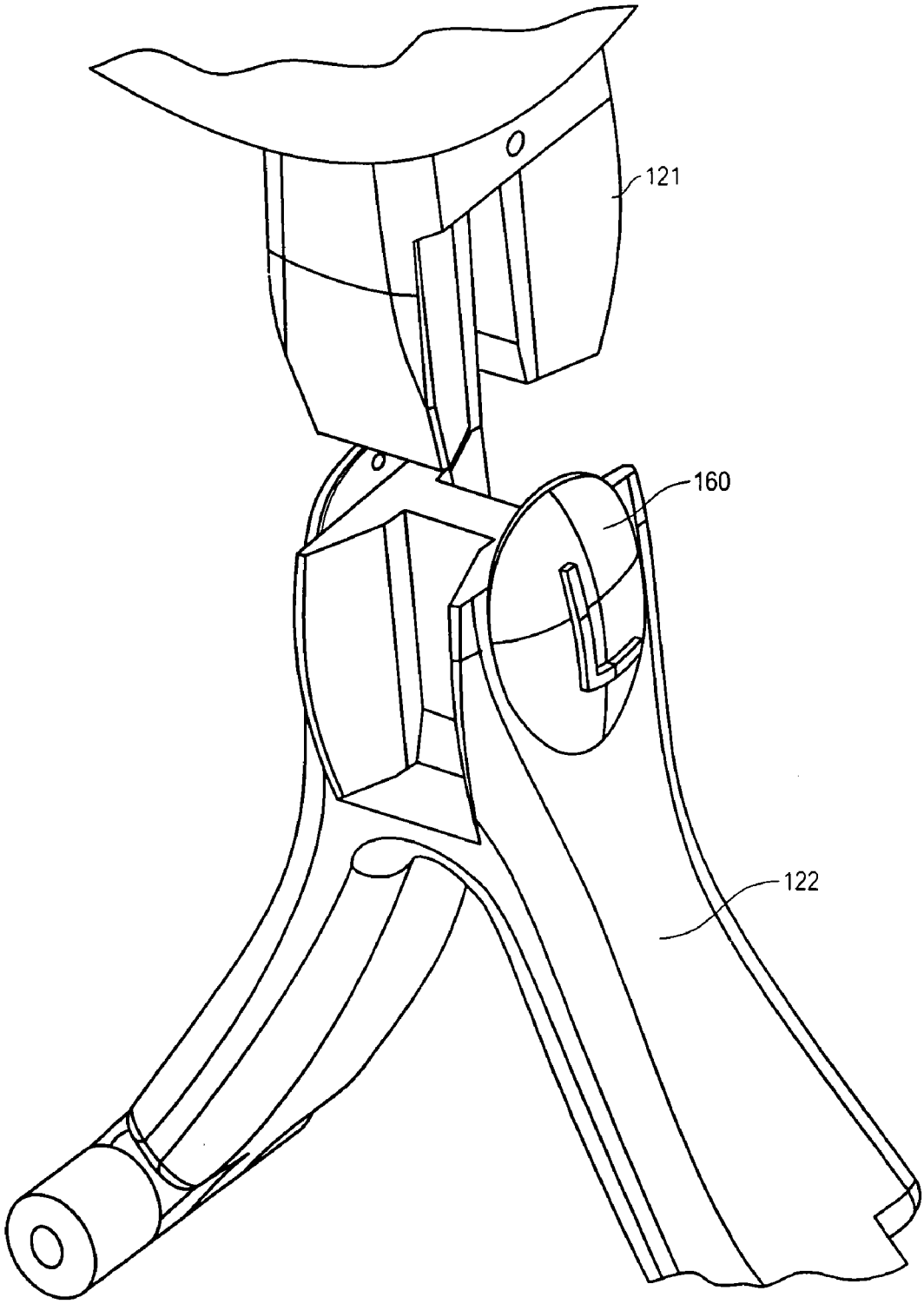
FIG. 2 is an exploded view showing enjoining between the lower holder assembly and the upper holder assembly.

FIG. 2 The holder assembly upper 120 connects to the holder assembly lower 122 by a holder joint 121. The holder joint preferably snaps together forming a non-removable integral unit.

The holder assembly lower forms a Y configuration having a pair of arm joint inner members 132 at their ends. Although the arm joint outer 131 is commonly attached to the arm second end 134, the joint mechanism can also be reversed having the arm joined other formed on the holder assembly 122 and the arm joint inner 132 mounted on the arm second end 134. The best mode envisions the arm joint as a pivot having a single plane of motion. Alternatively, an arm joint inner 132 can be formed as a ball fitting within a socket arm joint outer 131.

The arms if optionally omitted would require the suction cups to be mounted to the lower holder assembly at the joint where the arms would otherwise be mounted. In this case, the well would not be rectangular in cross-section and would be of the same cross-section as the remainder of the container. Preferably, arms are included as they allow user improved dexterity and comfort when installing contact lenses.

The lens support member 125 is formed on the holder assembly 120 or 122 and receives a contact lens 150 that is held in a suction cup 140. The suction cup is attached to a first arm end 133. The suction cup has a small enough diameter so that it loses connection with the contact lens 150 upon tangential force applied to the contact lens. The direction of the tangential force is in a direction that is perpendicular to the plane of the interface between the contact lens 150 and the suction cup 140.

The lens support member optionally omitted would require free floating of the contact lens still attached to the suction cup. Unfortunately, the contact lens may detach from the suction cup more easily because of agitation such as when a user participates in sports and carries the container in a pocket.

The suction cup 140 has a greater curvature than the contact lens 150 which it holds. The curvature difference creates a gap of low pressure between the suction cup and the contact lens. The suction cup 140 is approximately half of the diameter of the contact lens or smaller. The smaller diameter allows the user to break the seal that is the gap of low pressure. A user can break the seal a variety of ways. The preferred mode for breaking the seal is to turn the suction cup allowing air to enter through one edge of the suction cup.

The suction cup is mounted on the first arm end 133 so that it is centered over the lens-supporting member. The arm second end 134 has an arm joint connecting to an arm joint on the lower holder assembly 122. The arm joint can be made as a joint outer which is a socket receiving a joint pin. The socket has preferably a single degree of motion such that it rotates one hundred eighty degrees from an extended arm position 222, FIG. 3 to a stowed arm position 210.

In FIG. 3, the extended arm holds a suction cup that can be placed on a human eyeball by a user holding the cap 119 as a handle. The cap forming the handle does not rotate freely in relation to the spool means 118, although it rotates when biased by a user. Similarly, the extended arm 222 does not swing freely relative to the holder assembly when the arm is extended for placements of the contact lens on top of a user's eyeball.

As a safety feature, the arm joint 132 and 131 are formed not having sufficient bearing force to protect a user accidentally sticking the implement into the user's eyeball such as if a user involuntarily sneezes. In the safety mode, the arm joint outer 131 breaks off of the form joint inner 132 so that the user does not harm the eyeball. Also, the edges of the suction cup are soft preventing scratching to the cornea in case of accidents. The contact lens suction cup can be formed as a soft member having a cup portion and a mounting portion protruding from the cup portion. The mounting portion can be attached to the arm. Optionally, the mounting portion can also be attached to the joint where the arm is attached as long as the well is reconfigured in shape.

A user manually removes contact lenses from the eye and places them upon the suction cup for storage. The suction cup 140 adheres to the contact lens upon contact. The user folds the arm and stores the lenses until next use. The lenses soak in contact lens solution felt in the vial or container 510. In the morning typically, a user opens the container and unfolds the arms into extended position 222. The user holds the cap and positions the contact lens 150 and suction cup 140 to the eye. The user places the contact lens on the eye and then turns the device and suction cup to an off-center position breaking the suction between the contact lens and the suction cup such that the contact lens stays adhered to the eye.

As seen in figure five, a well 530 in a basically rectangular cross section shape stores the stowed arms 210 and prevents the turning or rotation of the holder assembly when the holder assembly is placed within the vial or container 510.

If a user can unfold the stowed arms, the user places the contact lens on the suction cup 140 and then folds the suction cup and contact lenses adhered to the suction cup into stowed position.

The spoke openings 129 formed between the supporting spokes 128 and the central depression 127 formed inside the supporting spokes 128 provide a supporting structure capable of holding a contact lens while not causing an abrasion to the contact lens or causing adhesion of the contact lens to the supporting structure. The supporting spokes 128 ideally form an arched profile matching the profile of the inside of a contact lens. The spokes preferably have rounded smooth top surfaces maintaining soft contact with the contact lens inside surface.

The out side annular support ring 126 prevents the slippage of the contact lens 150. The annular ring 126 retains the contact lens. Thus, when the contact lens is stowed it is held between the supporting structure, the suction cup 140 and the annular support ring 126. A left right insignia designation 160 is placed on the holder assembly lower portion 122 designating the contact lens as being from the left or right eye. The vial or container should be made of inert plastic such as polycarbonate.

The central depression 127 can be formed as a hollow passing through the lens support member 125 such that a user looking at the lenses support member can see through the central depression just as the spoke opening 129 communicates through the lens support member. The central depression is shaped so that it does not create substantial suction on the contact lens, although slight suction is allowable. The dimensions of a contact lens may differ and have different variances according to the user such as sphere, power, and diameter. The contact lens case including the lens support member and suction cup 140 are adapted and sized to the particular dimensions of the users.

The cap may have indentations allowing ease of grip when a user rotates the cap to secure it to the container. The indentations are often evenly spaced and can be decorative.

The invention claimed is:

1. A contact lens case comprising:

a. a container member forming a well for receiving contact lens fluid;

b. a cap fitting onto the container forming a watertight seal;

c. a holder assembly attached to the cap and fitting inside the container when the cap is closed on the container, the holder assembly member having a pair of suction cups, each suction cup for holding a single contact lens;

d. a lens support member formed on the holder assembly, the lens support member retaining the contact lens against the suction cup;

e. a spool means between the holder assembly and the cap, allowing cap turning relative to holder assembly; and f. arms holding the suction cup at a first arm end, a second arm end pivoting between a stowed position and an extended position, the arms joining the holder assembly at a joint;

wherein the well receives contact lens fluid when a user fills the container and wherein the well is rectangular in cross section receiving arms in stowed position and retaining the arms not allowing rotation of the holder assembly, the arms, the suction cups and the lens support member when a user rotates the cap to secure the cap to the container.

2. The contact lens case of claim 1, wherein the spool means is made of a locking inner spool locking with a locking outer spool.

3. The contact lens case of claim 1, wherein the suction cup is less than half the diameter of a contact lens and having a greater curvature allowing a gap between the contact lens and suction cup when the suction cup receives a contact lens.

4. The contact lens case of claim 1, wherein the arm joint breaks off upon excessive force applied so that the user does not harm an eyeball.

5. The contact lens case of claim 1, wherein, the edges of the suction cup are soft preventing cornea scratching in case of accidents.

* * * * *